US011069998B2

(12) United States Patent
Ho et al.

(10) Patent No.: US 11,069,998 B2
(45) Date of Patent: Jul. 20, 2021

(54) ELECTRICAL CONNECTOR

(71) Applicant: LOTES CO., LTD, Keelung (TW)

(72) Inventors: Chien Chih Ho, Keelung (TW); Jun Zhang, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 16/855,109

(22) Filed: Apr. 22, 2020

(65) Prior Publication Data

US 2021/0175656 A1 Jun. 10, 2021

(30) Foreign Application Priority Data

Dec. 10, 2019 (CN) ..... 201911259462.4

(51) Int. Cl.
*H01R 13/41* (2006.01)
*H01R 13/24* (2006.01)

(52) U.S. Cl.
CPC ..... *H01R 13/41* (2013.01); *H01R 13/2442* (2013.01); *H01R 13/2485* (2013.01)

(58) Field of Classification Search
CPC ..... H01R 13/41; H01R 13/2485; H01R 13/2442; H01R 12/57
See application file for complete search history.

(56) References Cited

U.S. PATENT DOCUMENTS 8,047,864 B1 * 11/2011 Ju ..... H05K 7/1007 439/342
8,052,436 B1 * 11/2011 Ju ..... H01R 12/57 439/83

FOREIGN PATENT DOCUMENTS

CN 201937059 U 8/2011
CN 108493650 B 11/2019

* cited by examiner

*Primary Examiner* — Briggitte R. Hammond
(74) *Attorney, Agent, or Firm* — Locke Lord LLP; Tim Tingkang Xia, Esq.

(57) ABSTRACT

An electrical connector includes an insulating body, and multiple terminals accommodated therein. Each terminal has a connecting portion, two side portions bending backward and extending from left and right sides of the connecting portion, two extending portions provided opposite to each other and extending downward from the two side portions, and two embracing arms connected to lower ends of the two extending portions. The two embracing arms jointly embrace a solder ball, which has a first vertical central plane in a front-rear direction. The two embracing arms are located on two sides of the first vertical central plane. A distance between the front ends of the two embracing arms is less than a distance between the rear ends of the two embracing arms of each terminal. The front ends of the two embracing arms are attached with solder liquid formed by melting of the solder ball during soldering.

20 Claims, 11 Drawing Sheets

100

100

100

ELECTRICAL CONNECTOR

CROSS-REFERENCE TO RELATED PATENT APPLICATION

This non-provisional application claims priority to and the benefit of, pursuant to 35 U.S.C. § 119(a), patent application Serial No. CN201911259462.4 filed in China on Dec. 10, 2019. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and particularly to an electrical connector with terminals clamping solder balls.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

An electrical connector shown in FIG. 1 and FIG. 2 includes an insulating body 5, multiple terminals 6 arranged in the insulating body 5, and multiple solder balls 7 fixed to the terminals 6. The solder balls 7 are melted to solder the terminals 6 to a circuit board (not shown). Each of the terminals 6 has a connecting portion 61, and the connecting portion 61 is generally U-shaped. Two extending portions 62 are symmetrically provided to extend downward from left and right sides of the connecting portion 61. A vertical central plane M of the solder ball 7 passes through the two extending portions 62. A lower end of each of the extending portions 62 is connected to an embracing arm 63, and the two embracing arms 63 jointly embrace the solder ball 7. A length of a front end A of each of the embracing arms 63 passing forward beyond a front end of the corresponding extending portion 62 is equal to a length of a rear end B of each of the embracing arms 63 passing backward beyond a rear end of the corresponding extending portion 62, such that the front ends A and the rear ends B of the two embracing arms 63 of the same terminal 2 are symmetrically provided with respect to the vertical central plane M. Thus, a distance between the front ends A of the two embracing arms 63 of the same terminal 2 is equal to a distance between the rear ends B of the two embracing arms 63.

However, the distance between the front ends A of the two embracing arms 63 is equal to the distance between the rear ends B of the two embracing arms 63, and the distance between the front ends A of the two embracing arms 63 and the distance between the rear ends B of the two embracing arms 63 are both relatively large. During soldering, the solder ball 7 is melted to form solder liquid, and the solder liquid will flow freely. Some solder liquid will flow to the left or right, resulting in only one of the two embracing arms 63 of some of the terminals 6 being attached with the solder liquid. (That is, some of the terminals are soldered at one side.) Some solder liquid flow forward or backward, resulting in both of the two embracing arms 63 of some of the terminals 6 being attached with the solder liquid. (That is, some of the terminals 6 are soldered at two sides.) Due to different soldering conditions of the terminals 6 (specifically, some of the terminals 6 are soldered at one side and some of the terminals 6 are soldered at two sides), impedances of the terminals 6 are different, which affects high frequency stability.

Therefore, a heretofore unaddressed need to design a novel electrical connector exists in the art to address the aforementioned deficiencies and inadequacies.

SUMMARY

In view of the deficiencies in the background, the present invention is directed to an electrical connector ensuring same impedance of the terminals.

To achieve the foregoing objective, the present invention adopts the following technical solutions.

An electrical connector includes: an insulating body, provided with a plurality of accommodating holes running through the insulating body vertically; and a plurality of terminals, respectively and correspondingly accommodated in the accommodating holes, wherein each of the terminals has a connecting portion, two side portions, two extending portions and two embracing arms, the two side portions respectively bend backward and extend from a left side and a right side of the connecting portion, the two extending portions are provided opposite to each other and extend downward from the two side portions, each of the two embracing arms is connected to a lower end of one of the extending portions, the two embracing arms jointly embrace a solder ball, the solder ball has a first vertical central plane in a front-rear direction and a second vertical central plane in a left-right direction, the second vertical central plane is perpendicular to the first vertical central plane, the two embracing arms are located on a left side and a right side of the first vertical central plane, a front end of each of the embracing arms passes forward beyond a front end of a corresponding one of the extending portions, the front end of each of the embracing arms pass forward beyond the second vertical central plane, a rear end of each of the embracing arms pass backward beyond the second vertical central plane, a distance between the front end of each of the embracing arms and the second vertical central plane is greater than a distance between the rear end of each of the embracing arms and the second vertical central plane, a distance between the front ends of the two embracing arms of each of the terminals is less than a distance between the rear ends of the two embracing arms of each of the terminals, and the front ends of the two embracing arms are close to each other, such that the front ends of the two embracing arms are both attached with solder liquid formed by melting of the solder ball during soldering.

In certain embodiments, the insulating body is provided with a plurality of stopping portions corresponding to the terminals, and each of the stopping portions is located above the front ends of the two embracing arms of a corresponding one of the terminals to stop the front ends of the two embracing arms of the corresponding one of the terminals from moving upward.

In certain embodiments, each of the stopping portions is provided to protrude from an inner wall of a corresponding accommodating hole of the accommodating holes and extends downward beyond a lower end of the corresponding accommodating hole, each of the stopping portions is provided with a guide surface tilting downward from the inner wall of the corresponding accommodating hole, and a lower end of the guide surface is flush with the lower end of the corresponding accommodating hole.

In certain embodiments, a portion of each of the embracing arms passing forward beyond the front end of the corresponding one of the extending portions is defined as a first protruding portion, each of the embracing arms has a second protruding portion passing backward beyond a rear end of the corresponding one of the extending portions, a length of the first protruding portion is greater than a length of the second protruding portion, and the second vertical central plane passes through the two extending portions.

In certain embodiments, the first protruding portion and the second protruding portion tilt downward from top thereof in a direction close toward the solder ball, a top end of the first protruding portion is higher than a ball center of the solder ball, a bottom end of the first protruding portion is lower than the ball center of the solder ball, and a top end of the second protruding portion is not higher than the ball center of the solder ball.

In certain embodiments, when the terminals which are connected to a strip are expanded on a plane, a gap exists between the two adjacent extending portions of two adjacent terminals of the terminals, and the two adjacent second protruding portions of the two adjacent terminals are connected.

In certain embodiments, when the solder ball is melted to form the solder liquid, a gap between the front ends of the two embracing arms of each of the terminals is filled with the solder liquid.

In certain embodiments, when the two embracing arms of each of the terminals are expanded on a plane, the front ends of the two embracing arms of each of the terminals are connected to each other.

In certain embodiments, a base is formed by extending upward from the connecting portion and is positioned in a corresponding accommodating hole of the accommodating holes, a strip connecting portion is formed by extending upward from the base to be connected to a strip, an elastic arm is formed by bending upward and extending from the base to abut a mating component upward, the elastic arm has a first tearing edge formed with the strip connecting portion by tearing, a second tearing edge formed with the strip by tearing, and a blanking edge formed with the strip by blanking, and a notch is concavely provided on the elastic arm at a connection location between the blanking edge and the second tearing edge.

In certain embodiments, a plurality of supporting blocks are provided to protrude upward from an upper surface of the insulating body to support a mating component, each of the supporting blocks is connected to two rear adjacent accommodating holes and one front adjacent accommodating hole of the accommodating holes, and a portion of each of the supporting blocks is located between the two rear adjacent accommodating holes.

Compared with the related art, a distance between the front end of each embracing arm and the second vertical central plane is greater than a distance between a rear end of each embracing arm and the second vertical central plane, and the distance between the front ends of the two embracing arms is less than the distance between the rear ends of the two embracing arms, and the front ends of the two embracing arms are close to each other. (That is, the distance between the front ends of the two embracing arms is smaller.) During soldering, the solder ball is melted to form the solder liquid, and the solder liquid can be sucked at a small distance, such that the front ends of the two embracing arms are both attached with the solder liquid formed by melting of the solder ball. The two embracing arms of each of the terminals are both attached with the solder liquid (that is, each terminal is soldered on two sides) to ensure the same impedance of the terminals.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
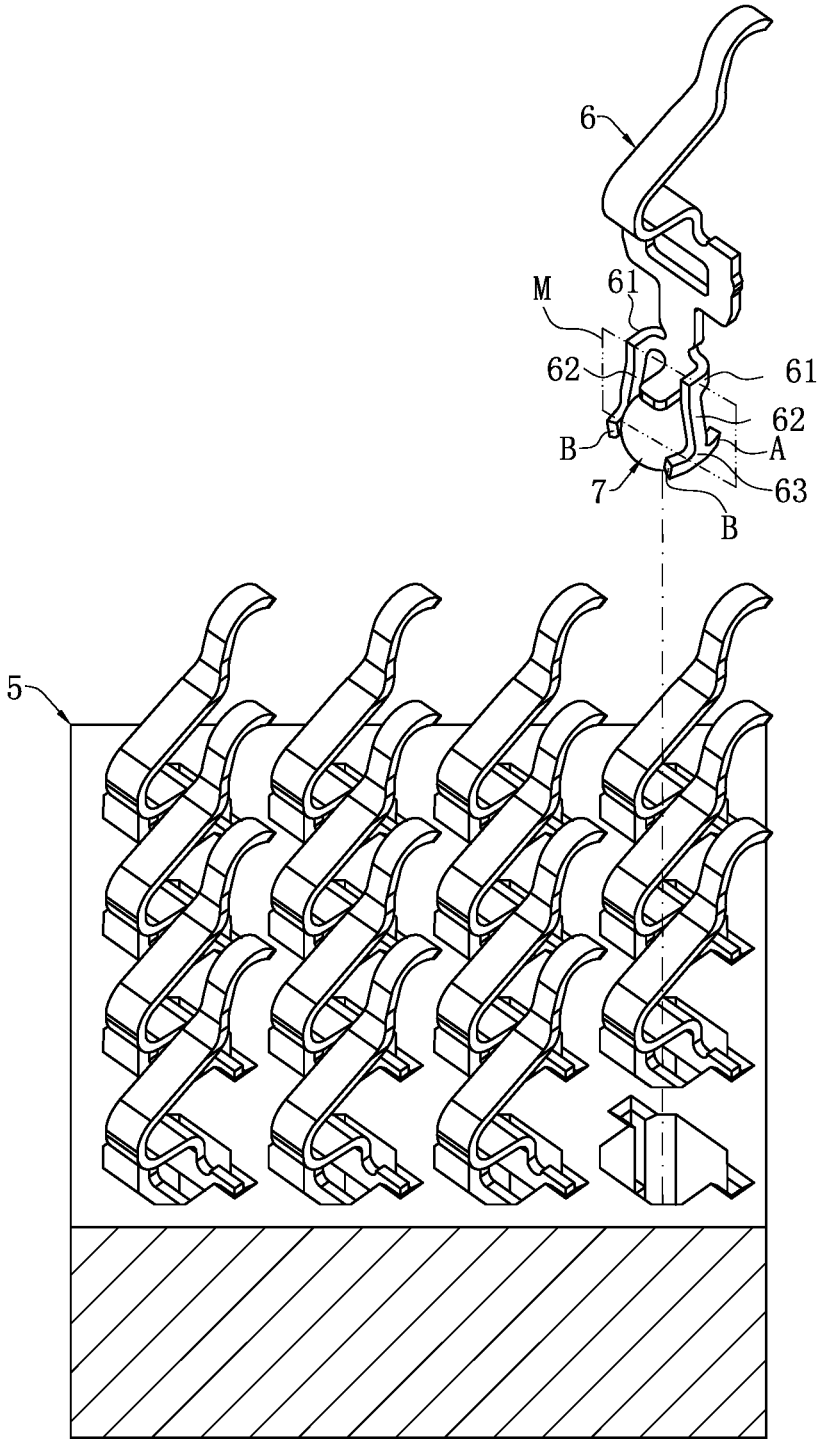
FIG. 1 (Related Art)
FIG. 1 is a perspective view of the related art.
Figure 2:
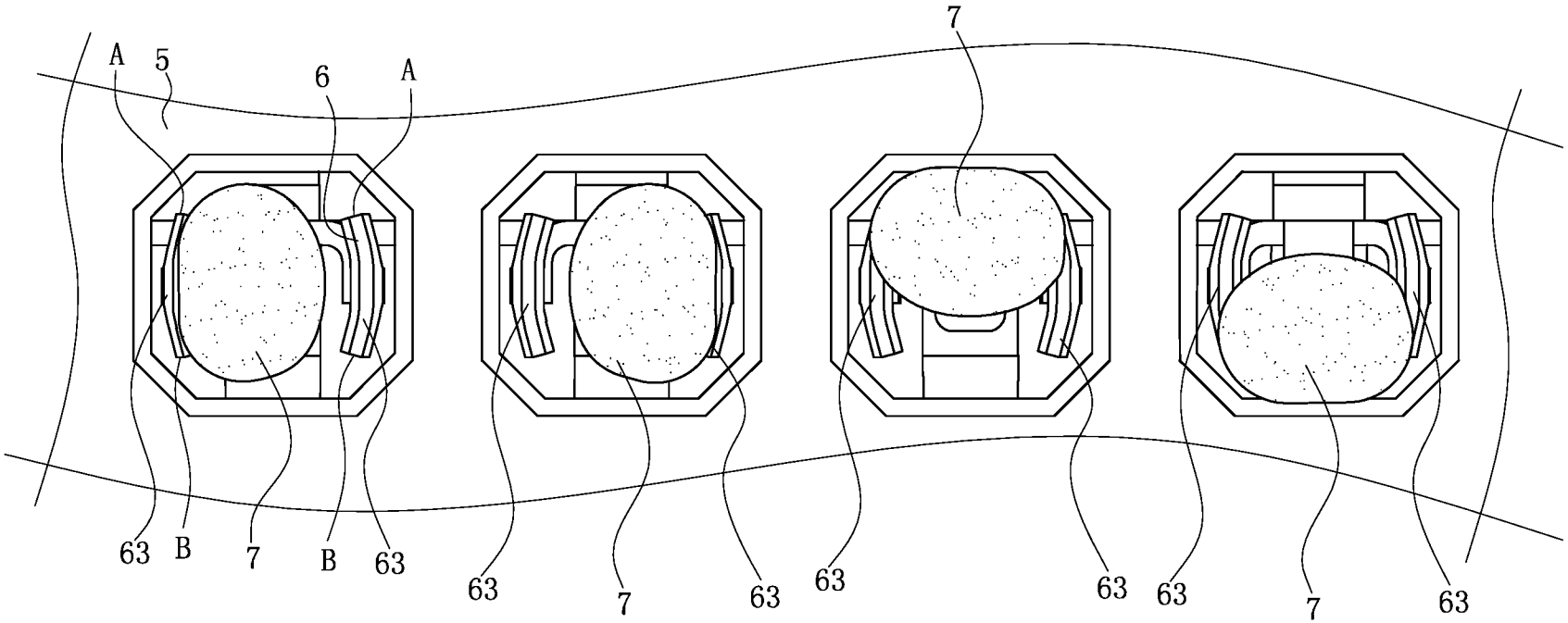
FIG. 2 (Related Art)
FIG. 2 is a bottom view of FIG. 1.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 3-11. In accordance with the purposes of this invention, as embodied and broadly described herein, this invention, in one aspect, relates to an electrical connector.

As shown in FIGS. 3-11, an electrical connector 100 according to certain embodiments of the present invention is configured to electrically connect a mating component 200 to a circuit board 300, and includes an insulating body 1 and multiple terminals 2 positioned in the insulating body 1.

Figure 3:
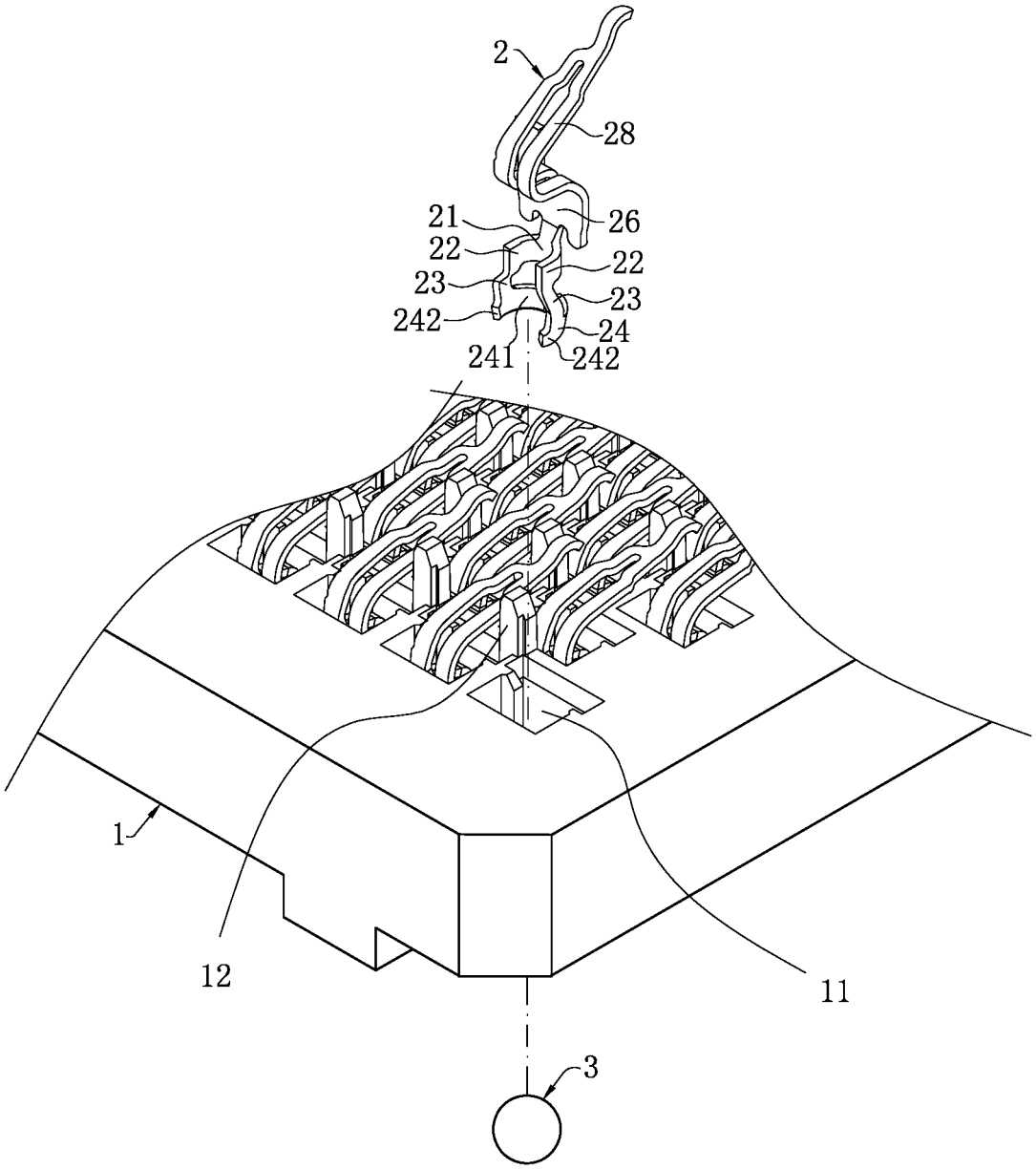
FIG. 3 is a perspective view of an electrical connector according to certain embodiments of the present invention.
Figure 6:
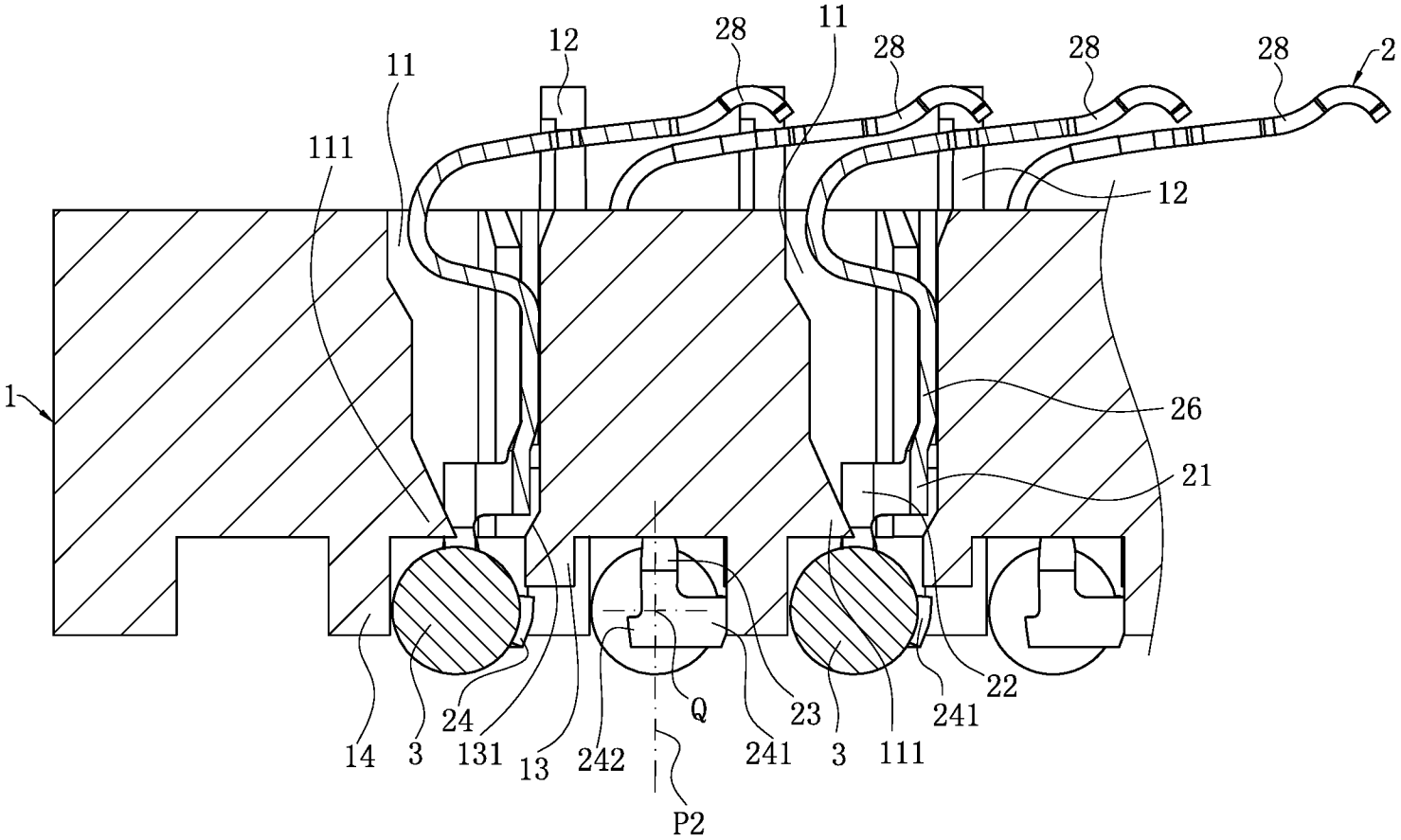
FIG. 6 is a sectional view of FIG. 3.
Figure 8:
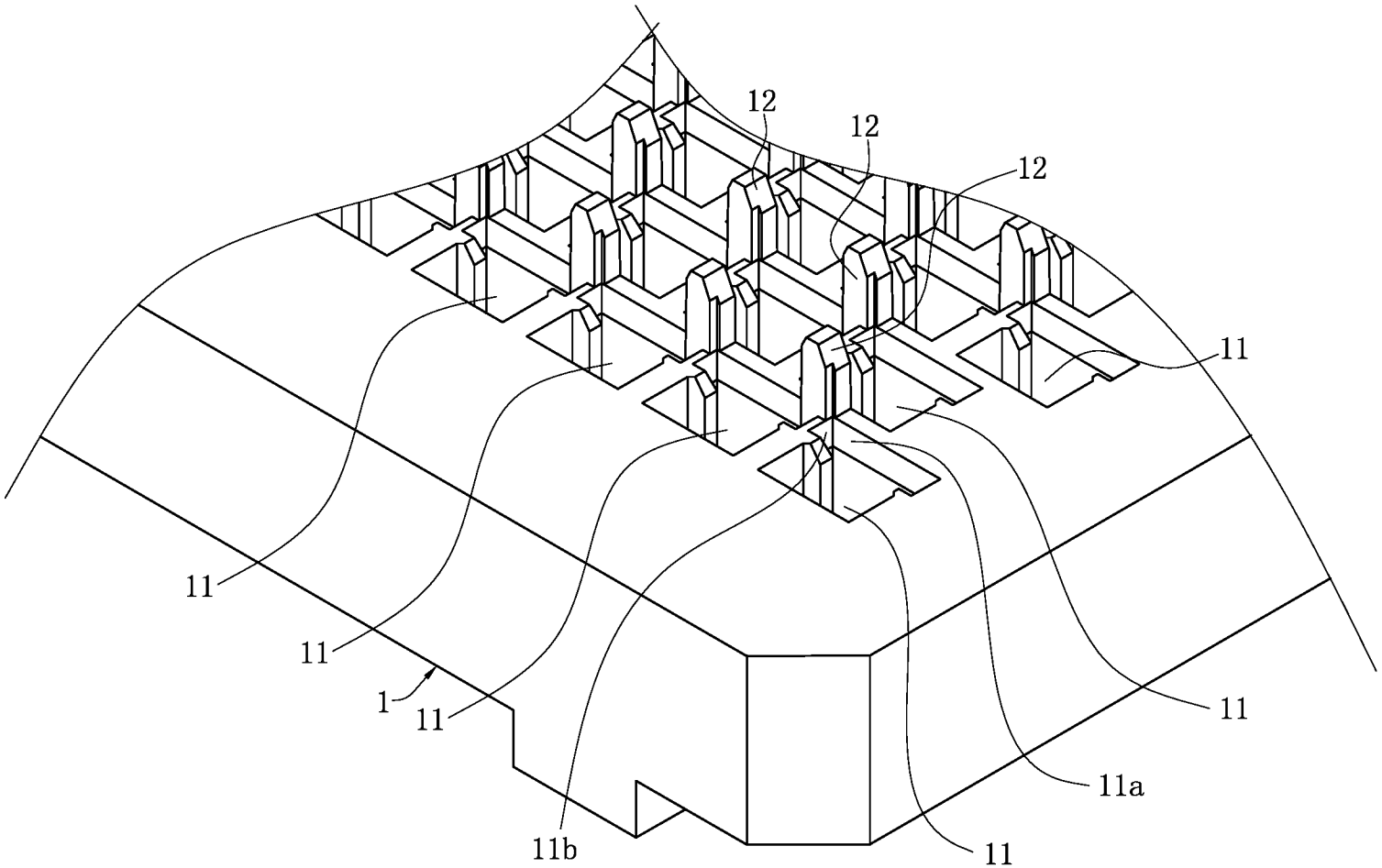
FIG. 8 is a perspective view of an insulating body according to certain embodiments of the present invention.

As shown in FIG. 3, FIG. 6 and FIG. 8, the insulating body 1 is provided with multiple accommodating holes 11 running through the insulating body 1 vertically to correspondingly accommodate the terminals 2. Multiple supporting blocks 12 protrude upward from an upper surface of the insulating body 1. Each supporting block 12 is connected to two adjacent inner walls of a corresponding accommodating hole 11.

Figure 4:
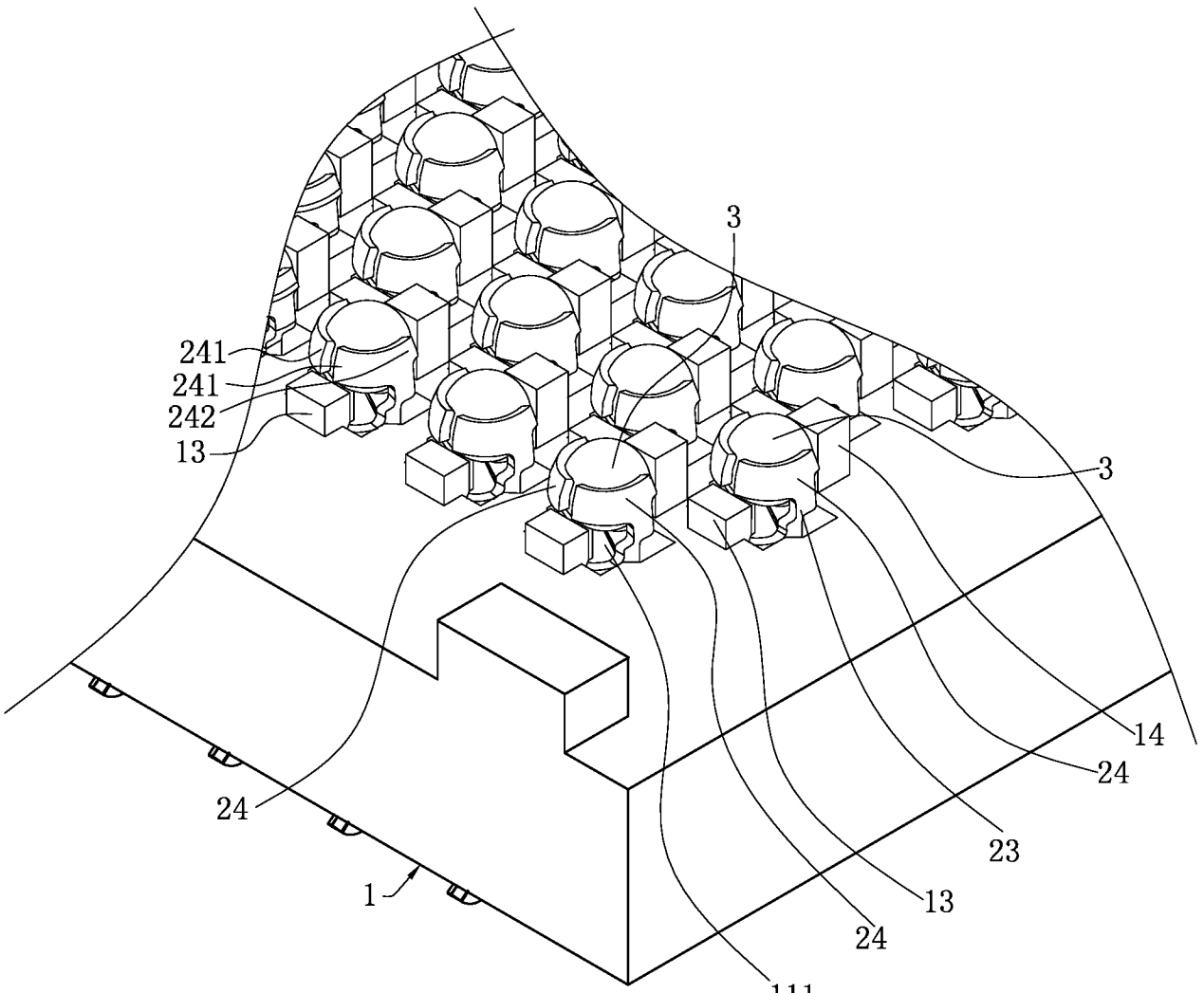
FIG. 4 is an inversed perspective view of FIG. 3.

Specifically, each supporting block 12 is connected to the front inner wall and the left inner wall of the corresponding accommodating hole 11, and is connected to the inner walls of the two rear adjacent accommodating holes 11 and the inner wall of a front adjacent accommodating hole 11, and a portion of the supporting block 12 is located between the two rear adjacent accommodating holes 11, such that a width of each supporting block 12 in a front-rear direction is greater than a distance between the rear inner wall of the front adjacent accommodating hole 11 and the front inner walls of the rear adjacent accommodating holes 11. Thus, the supporting blocks 12 may be provided wider, thereby enhancing strength thereof. As shown in FIG. 4 and FIG. 6, a stopping portion 13 is provided to protrude from the front inner wall of each of the accommodating holes 11 and extend downward beyond a lower end of the corresponding accommodating hole 11. Each stopping portion 13 is provided with a guide surface 131 tilting downward from the front inner wall of the corresponding accommodating hole 11, and a lower end of the guide surface 131 is flush with the lower end of the corresponding accommodating hole 11, such that a mold is easy to process. A protruding block 14 protrudes downward from a lower surface of the insulating body 1 behind each of the accommodating holes 11, and is downward supported on the circuit board 300. As shown in FIG. 4 and FIG. 6, a position limiting block 111 protrudes from the rear inner wall of each of the accommodating holes 11, and the position limiting block 111 is flush with the lower end of the corresponding accommodating hole 11.

Figure 9:
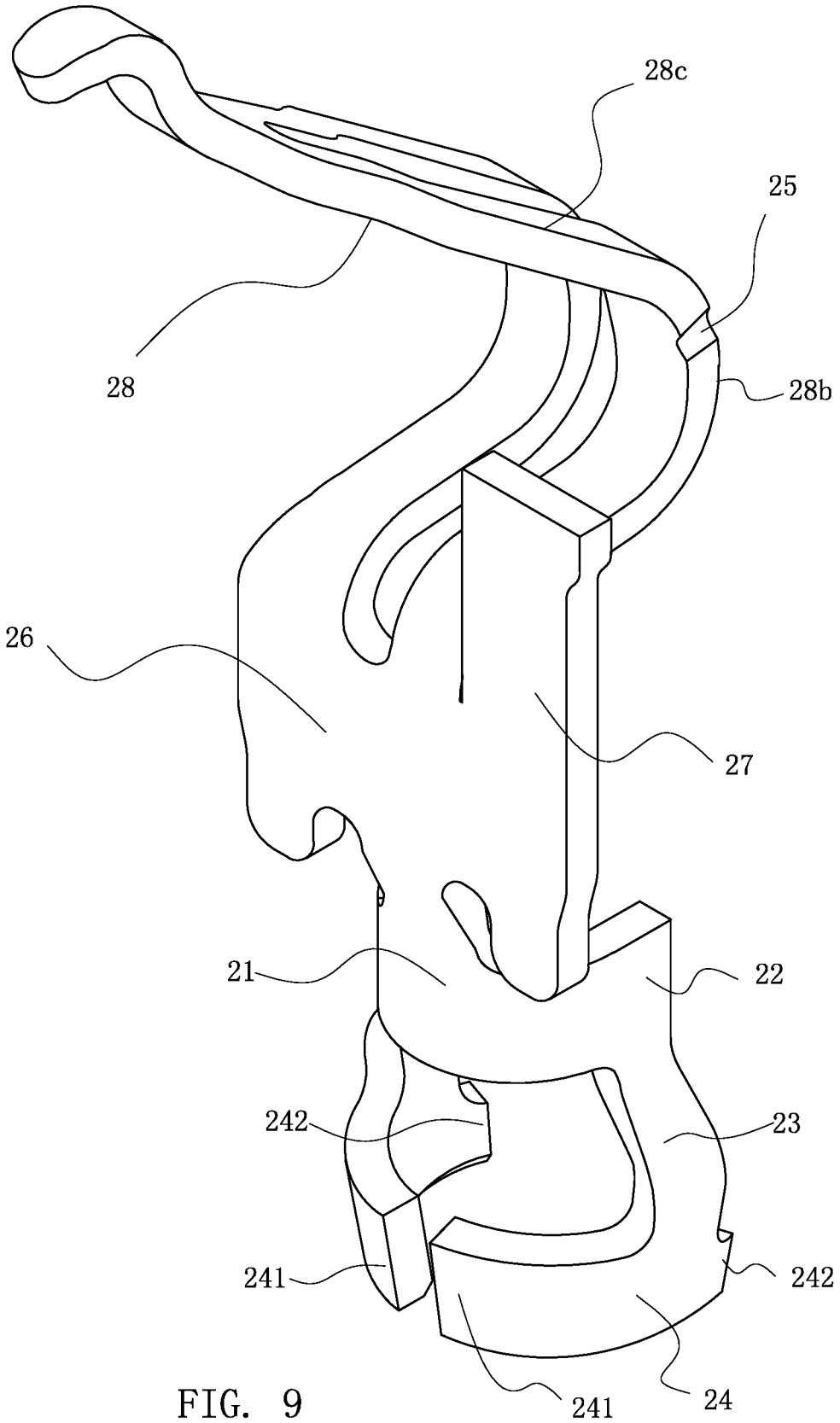
FIG. 9 is a perspective view of a terminal according to certain embodiments of the present invention.
Figure 10:
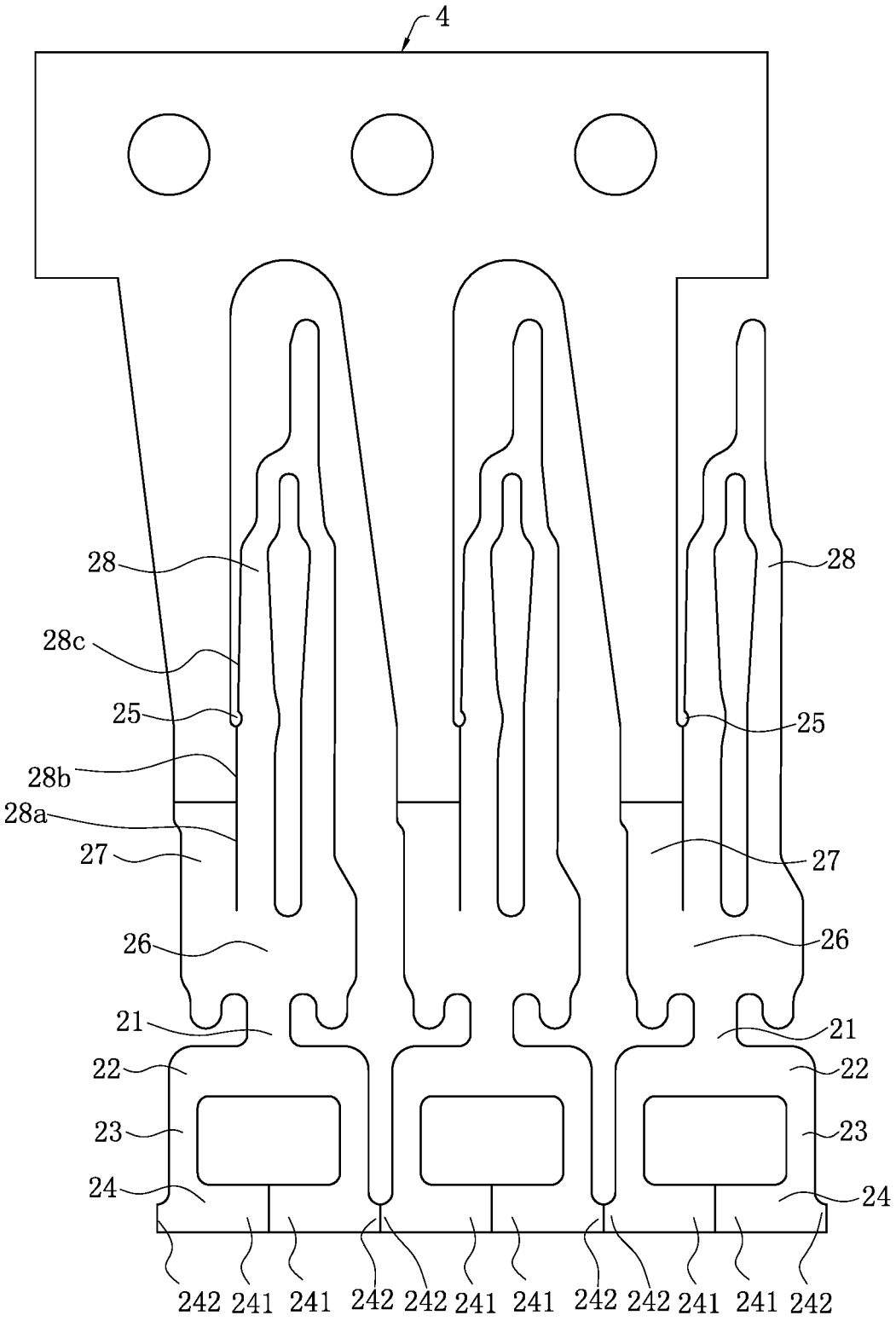
FIG. 10 is a plain expanded view of the terminal connected to a strip according to certain embodiments of the present invention.
Figure 11:
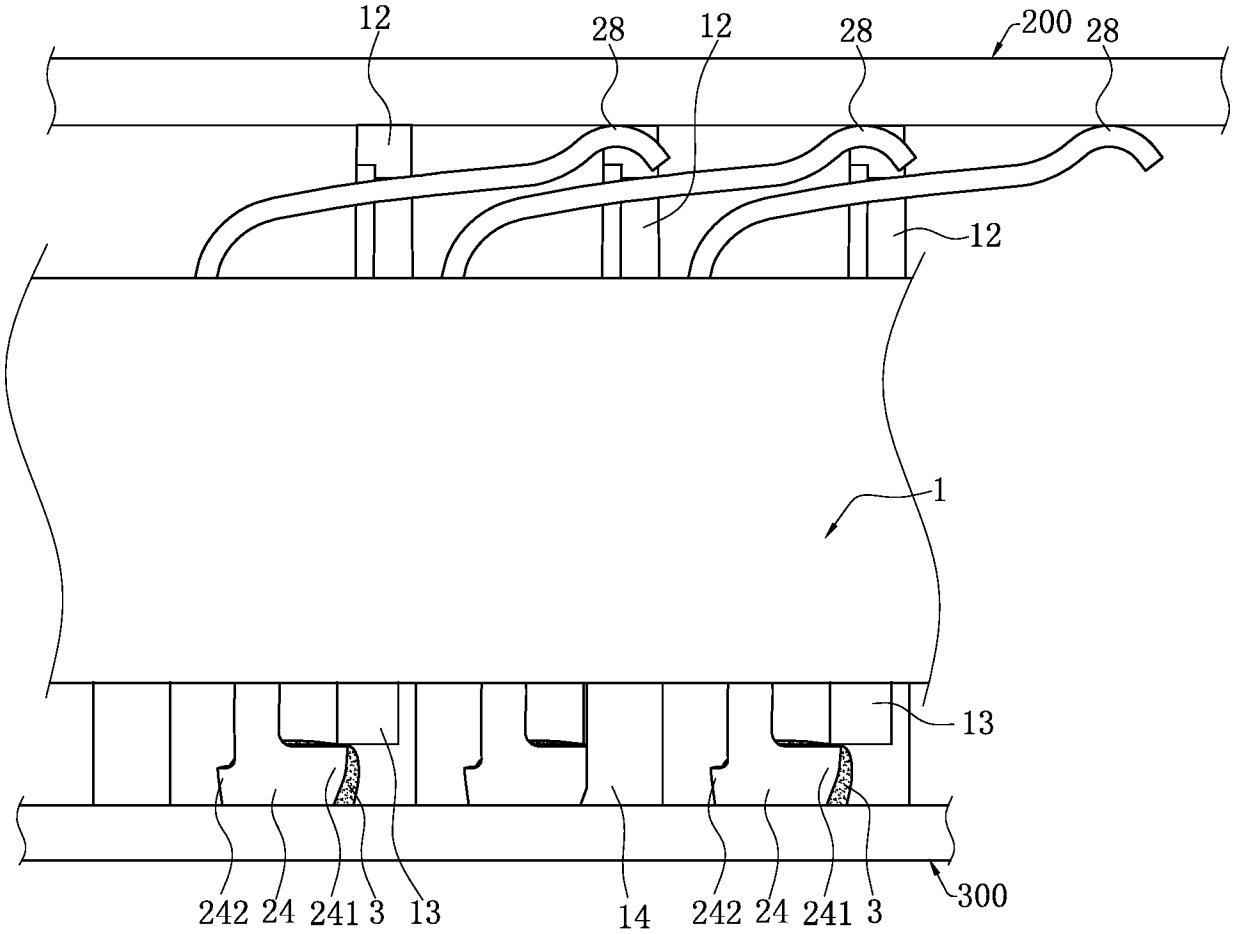
FIG. 11 is a schematic view of an electrical connector electrically connecting a mating component to a circuit board according to certain embodiments of the present invention.

As shown in FIG. 6, FIG. 9, FIG. 10 and FIG. 11, each of the terminals 2 has a base 26 positioned in the corresponding accommodating hole 11. The base 26 is vertically flat plate shaped. A strip connecting portion 27 is formed by extending upward from the base 26 to be connected to a strip 4. An elastic arm 28 is formed by firstly bending backward and extending from the base 26, and then bending forward and extending to upward abut the mating component 200. As shown in FIG. 10, the elastic arm 28 has a first tearing edge 28*a* formed with the strip connecting portion 27 by tearing. The elastic arm 28 has a second tearing edge 28*b* formed with the strip 4 by tearing. The elastic arm 28 further has a blanking edge 28*c* formed with the strip 4 by blanking. A notch 25 is concavely provided at one side of the elastic arm 28 close to the strip connecting portion 27 (that is, the left side of the elastic arm 28) and is higher than the strip connecting portion 27. The notch 25 is located at a connecting location between the blanking edge 28*c* and the second tearing edge 28*b*. The arrangement of the notch 25 prevents a mold edge from being provided with a sharp corner at the connecting location between the blanking edge 28*c* and the second tearing edge 28*b*, thus prolonging the service life of the mold.

Figure 5:
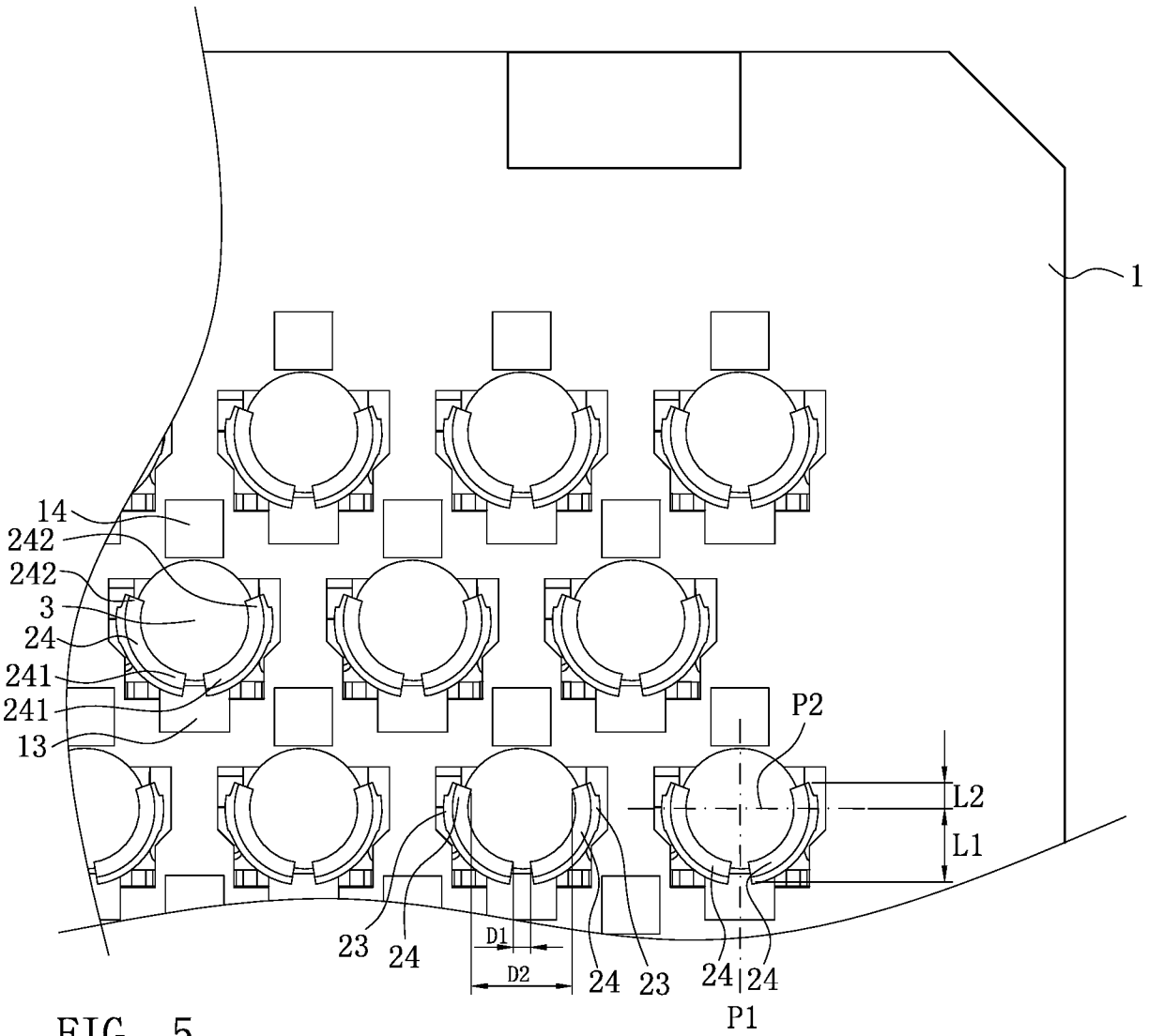
FIG. 5 is a bottom view of FIG. 3.
Figure 7:
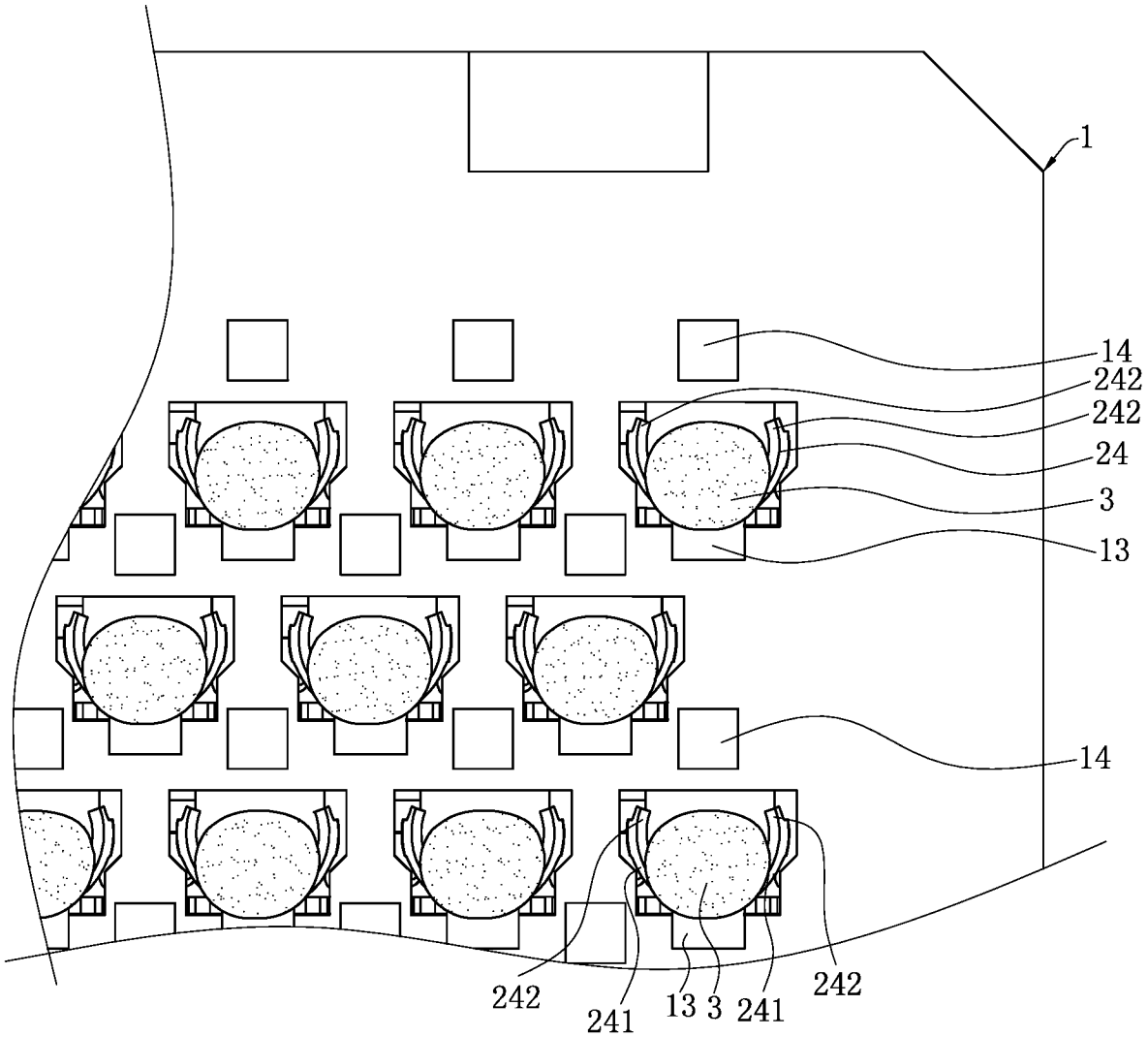
FIG. 7 is a schematic view of a solder ball of FIG. 5 after melting.

As shown in FIG. 4, FIG. 6 and FIG. 9, a connecting portion 21 is formed by bending downward and backward and extending from the base 26. A width of the connecting portion 21 is less than a width of the base 26. The connecting portion 21 has better elasticity. A side portion 22 is formed by bending backward and extending from each of the left and right sides of the connecting portion 21. Two extending portions 23 are formed by extending downward and expanding outward from the two side portions 22. The two extending portions 23 are provided opposite to each other. A lower end of each of the extending portions 23 is connected to an embracing arm 24. The stopping portion 13 is located above a front end of the embracing arm 24 to stop the front end of the embracing arm 24 from moving upward. The guide surface 131 guides the embracing arms 24 to move downward to extend out of the lower end of the corresponding accommodating hole 11. The two embracing arms 24 jointly embrace a solder ball 3. In this embodiment, a diameter of the solder ball 3 is 0.52 mm. The solder ball 3 is melted to solder the corresponding terminal 2 to the circuit board 300. As shown in FIG. 5, FIG. 6 and FIG. 7, the solder ball 3 has a first vertical central plane P1 in the front-rear direction and a second vertical central plane P2 in the left-right direction. The second vertical central plane P2 is perpendicular to the first vertical central plane P1. The second vertical central plane P2 passes through the two extending portions 23. The two embracing arms 24 are located at left and right sides of the first vertical central plane P1, such that the solder ball 3 may be limited from moving in the left-right direction. The front end of each embracing arm 24 passes forward beyond the second vertical central plane P2 and a rear end of each embracing arm 24 passes backward beyond the second vertical central plane P2, such that the solder ball 3 is limited from moving in the front-rear direction. The front end of each embracing arm 24 passes forward beyond the second vertical central plane P2, and the rear end of each embracing arm 24 passes backward beyond the second vertical central plane P2, A distance L1 between the front end of each embracing arm 24 and the second vertical central plane P2 is greater than a distance L2 between a rear end of each embracing arm 24 and the second vertical central plane P2, and a distance D1 between the front ends of the two embracing arms 24 is less than a distance D2 between the rear ends of the two embracing arms 24 of each terminal 2, and the front ends of the two embracing arms 24 are close to each other. Thus, during soldering, the front ends of the two embracing arms 24 are both attached with solder liquid formed by melting of the solder ball 3. When the solder ball 3 is not melted, the two embracing arms 24 of each terminal 2 are elastically expanded by the solder ball 3. At this time, the distance between the front ends of the two embracing arms 24 of each terminal 2 is within 0.15 mm. When the solder ball 3 is melted to form the solder liquid, the two embracing arms 24 are elastically recovered, such that the front ends of the two embracing arms 24 are converged to be closer to each other, and the distance between the front ends is reduced to be within 0.10 mm, such that a gap between the front ends of the two embracing arms 24 of each terminal 2 is filled with the solder liquid. The front end of each of the embracing arms 24 passes forward beyond a front end of the corresponding extending portion 23. A portion of the embracing arm 24 passing forward beyond the front end of the corresponding extending portion 23 is defined as a first protruding portion 241. A top end of the first protruding portion 241 is higher than a ball center Q of the solder ball 3. A bottom end of the first protruding portion 241 is lower than the ball center Q of the solder ball 3. The first protruding portion 241 tilts downward from top thereof in a direction close toward the solder ball 3. As shown in FIG. 10, when the two embracing arms 24 of each terminal 2 are expanded on a plane, the two first protruding portions 241 of each terminal 2 are connected, and the two first protruding portions 241 are mutually formed by tearing, such that the two first protruding portions 241 can be provided at the maximum length. As shown in FIG. 5, FIG. 6 and FIG. 7, the rear end of each embracing arm 24 passes backward beyond a rear end of the corresponding extending portion 23. In other embodiments, the rear end of each embracing arm 24 may also be flush with the rear end of the corresponding extending portion 23. A portion of the rear end of each embracing arm 24 passing backward beyond the rear end of the extending portion 23 is defined as a second protruding portion 242. A length of the first protruding portion 241 is greater than a length of the second protruding portion 242. The second protruding portion 242 tilts downward from top thereof in a direction close toward the solder ball 3. A top end of the second protruding portion 242 is not higher than the ball center Q of the solder ball 3 (that is, the top end of the second protruding portion 242 is equal to or lower than the ball center Q of the solder ball 3), such that the second protruding portion 242 is convenient to bend. As shown in FIG. 10, when the terminals 2 which are connected to the strip 4 are expanded on a plane, the two adjacent second protruding portions 242 of the two adjacent terminals 2 are connected. Thus, the two adjacent second protruding portions 242 of the two adjacent terminals 2 are arranged at a zero distance, such that the terminals 2 connected to the strip 4 can be arranged more closely, reducing a distance between center lines of the two adjacent terminals 2, reducing blanking in a stamping process, and saving materials. As shown in FIG. 4, FIG. 5 and FIG. 6, the protruding block 14 is configured to limit the solder ball 3 from moving backward when the solder ball 3 is loaded upward. When the solder ball 3 is loaded between the two embracing arms 24 of the corresponding terminal 2, the solder ball 3 is not in contact with the corresponding protruding block 14. The solder ball 3 is fixed by being embraced by the two embracing arms 24 of the terminal 2, that is, the solder ball 3 is fixed without the need of the insulating body 1, thereby preventing the insulating body 1 from being applied with force, and reducing the warping deformation of the insulating body 1. The position limiting block 111 is located above the solder ball 3 to stop the solder ball 3 from moving excessively upward when the solder ball 3 is loaded into the corresponding accommodating hole 11.

Compared with the related art, the electrical connector 100 according to certain embodiments of the present invention has the following beneficial effects:

1. A distance L1 between the front end of each embracing arm 24 and the second vertical central plane P2 is greater than a distance L2 between a rear end of each embracing arm 24 and the second vertical central plane P2, and the distance D1 between the front ends of the two embracing arms 24 is less than the distance D2 between the rear ends of the two embracing arms 24, and the front ends of the two embracing arms 24 are close to each other. During soldering, the solder ball 3 is melted to form the solder liquid, and the solder liquid can be sucked at a small distance, such that the front ends of the two embracing arms 24 are both attached with the solder liquid formed by the melting of the solder ball 3. The two embracing arms 24 of each of the terminals 2 are both attached with the solder liquid to ensure the same impedance of the terminals 2.

2. Since the stopping portion 13 is located above the front ends of the embracing arms 24, when the solder ball 3 is loaded upward, the embracing arms 24 move forward to get close to the stopping portion 13, such that an abutting area of the stopping portion 13 and the two embracing arms 24 increases, and the embracing arms 24 are stopped by the stopping portion 13 more stably. (If the stopping portion 13 is located above the rear ends of the embracing arms 24, when the solder ball 3 is loaded upward, the embracing arms 24 move forward and get away from the stopping portion 13, which may cause the stopping portion 13 not to stop the embracing arms 24, and thus, the terminal 2 may move upward.) The solder ball 3 can be smoothly assembled to the terminal 2.

3. When the two embracing arms 24 of each terminal 2 are expanded on the plane, the two first protruding portions 241 are connected, such that the two first protruding portions 241 can be provided at the maximum length, such that after the terminal 2 is molded, a distance between the two first protruding portions 241 is smaller. During soldering, the solder ball 3 is melted to form the solder liquid, and the solder liquid is convenient to suck at a smaller distance.

4. When the terminals 2 which are connected to the strip 4 are expanded on the plane, a gap exists between the two adjacent extending portions 23 of the two adjacent terminals 2, and the two adjacent second protruding portions 242 of the two adjacent terminals 2 are connected. That is, the two adjacent extending portions 23 of the two adjacent terminals 2 are formed by blanking, and the two adjacent second protruding portions 242 of the two adjacent terminals 2 are mutually formed by tearing, thus reducing a tearing length of the two adjacent terminals 2 and ensuring a tearing effect.

Meanwhile, the two adjacent second protruding portions 242 of the two adjacent terminals 2 are connected, and the two adjacent second protruding portions 242 of the adjacent terminals 2 are arranged at a zero distance, such that the terminals 2 connected to the strip 4 can be arranged more closely, reducing the distance between the center lines of the two adjacent terminals 2, reducing the blanking in the stamping process, saving the materials, and facilitating densified arrangement of terminals 2.

5. Each supporting block 12 is connected to two rear adjacent accommodating holes 11 and is connected to a front adjacent accommodating hole 11, and a portion of the supporting block 12 is located between the two rear adjacent accommodating holes 11, such that the width of the supporting block 12 in the front-rear direction is greater than the distance between the rear inner wall of the front adjacent accommodating hole 11 and the front inner walls of the rear adjacent accommodating holes 11, allowing the supporting block 12 to be provided wider, thereby enhancing the strength thereof.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

an insulating body, provided with a plurality of accommodating holes running through the insulating body vertically; and a plurality of terminals, respectively and correspondingly accommodated in the accommodating holes, wherein each of the terminals has a connecting portion, two side portions, two extending portions and two embracing arms, the two side portions respectively bend backward and extend from a left side and a right side of the connecting portion, the two extending portions are provided opposite to each other and extend downward from the two side portions, each of the two embracing arms is connected to a lower end of one of the extending portions, the two embracing arms jointly embrace a solder ball, the solder ball has a first vertical central plane in a front-rear direction and a second vertical central plane in a left-right direction, the second vertical central plane is perpendicular to the first vertical central plane, the two embracing arms are located on a left side and a right side of the first vertical central plane, a front end of each of the embracing arms passes forward beyond a front end of a corresponding one of the extending portions, the front end of each of the embracing arms pass forward beyond the second vertical central plane, a rear end of each of the embracing arms pass backward beyond the second vertical central plane, a distance between the front end of each of the embracing arms and the second vertical central plane is greater than a distance between the rear end of each of the embracing arms and the second vertical central plane, a distance between the front ends of the two embracing arms of each of the terminals is less than a distance between the rear ends of the two embracing arms of each of the terminals, and the front ends of the two embracing arms are close to each other, such that the front ends of the two embracing arms are both attached with solder liquid formed by melting of the solder ball during soldering, wherein a portion of each of the embracing arms passing forward beyond the front end of the corresponding one of the extending portions is defined as a first protruding portion, each of the embracing arms has a second protruding portion passing backward beyond a rear end of the corresponding one of the extending portions, a length of the first protruding portion is greater than a length of the second protruding portion, and the second vertical central plane passes through the two extending portions.

2. The electrical connector according to claim 1, wherein the insulating body is provided with a plurality of stopping portions corresponding to the terminals, and each of the stopping portions is located above the front ends of the two embracing arms of a corresponding one of the terminals to stop the front ends of the two embracing arms of the corresponding one of the terminals from moving upward.

3. The electrical connector according to claim 2, wherein each of the stopping portions is provided to protrude from an inner wall of a corresponding accommodating hole of the accommodating holes and extends downward beyond a lower end of the corresponding accommodating hole, each of the stopping portions is provided with a guide surface tilting downward from the inner wall of the corresponding accommodating hole, and a lower end of the guide surface is flush with the lower end of the corresponding accommodating hole.

4. The electrical connector according to claim 1, wherein the first protruding portion and the second protruding portion tilt downward from top thereof in a direction close toward the solder ball, a top end of the first protruding portion is higher than a ball center of the solder ball, a bottom end of the first protruding portion is lower than the ball center of the solder ball, and a top end of the second protruding portion is not higher than the ball center of the solder ball.

5. The electrical connector according to claim 1, wherein when the terminals which are connected to a strip are expanded on a plane, a gap exists between the two adjacent extending portions of two adjacent terminals of the terminals, and the two adjacent second protruding portions of the two adjacent terminals are connected.

6. The electrical connector according to claim 1, wherein when the solder ball is melted to form the solder liquid, a gap between the front ends of the two embracing arms of each of the terminals is filled with the solder liquid.

7. The electrical connector according to claim 1, wherein when the two embracing arms of each of the terminals are expanded on a plane, the front ends of the two embracing arms of each of the terminals are connected to each other.

8. The electrical connector according to claim 1, wherein a base is formed by extending upward from the connecting portion and is positioned in a corresponding accommodating hole of the accommodating holes, a strip connecting portion is formed by extending upward from the base to be connected to a strip, an elastic arm is formed by bending upward and extending from the base to abut a mating component upward, the elastic arm has a first tearing edge formed with the strip connecting portion by tearing, a second tearing edge formed with the strip by tearing, and a blanking edge formed with the strip by blanking, and a notch is concavely provided on the elastic arm at a connection location between the blanking edge and the second tearing edge.

9. The electrical connector according to claim 1, wherein a plurality of supporting blocks are provided to protrude upward from an upper surface of the insulating body to support a mating component, each of the supporting blocks is connected to two rear adjacent accommodating holes and one front adjacent accommodating hole of the accommodating holes, and a portion of each of the supporting blocks is located between the two rear adjacent accommodating holes.

10. An electrical connector, comprising:

an insulating body, provided with a plurality of accommodating holes running through the insulating body vertically; and a plurality of terminals, respectively and correspondingly accommodated in the accommodating holes, wherein each of the terminals has a connecting portion, two side portions, two extending portions and two embracing arms, the two side portions respectively bend backward and extend from a left side and a right side of the connecting portion, the two extending portions are provided opposite to each other and extend downward from the two side portions, each of the two embracing arms is connected to a lower end of one of the extending portions, the two embracing arms jointly embrace a solder ball, the solder ball has a first vertical central plane in a front-rear direction and a second vertical central plane in a left-right direction, the second vertical central plane is perpendicular to the first vertical central plane, the two embracing arms are located on a left side and a right side of the first vertical central plane, a front end of each of the embracing arms passes forward beyond a front end of a corresponding one of the extending portions, the front end of each of the embracing arms pass forward beyond the second vertical central plane, a rear end of each of the embracing arms pass backward beyond the second vertical central plane, a distance between the front end of each of the embracing arms and the second vertical central plane is greater than a distance between the rear end of each of the embracing arms and the second vertical central plane, a distance between the front ends of the two embracing arms of each of the terminals is less than a distance between the rear ends of the two embracing arms of each of the terminals, and the front ends of the two embracing arms are close to each other, such that the front ends of the two embracing arms are both attached with solder liquid formed by melting of the solder ball during soldering, wherein the insulating body is provided with a plurality of stopping portions corresponding to the terminals, and each of the stopping portions is located above the front ends of the two embracing arms of a corresponding one of the terminals to stop the front ends of the two embracing arms of the corresponding one of the terminals from moving upward.

11. The electrical connector according to claim 10, wherein each of the stopping portions is provided to protrude from an inner wall of a corresponding accommodating hole of the accommodating holes and extends downward beyond a lower end of the corresponding accommodating hole, each of the stopping portions is provided with a guide surface tilting downward from the inner wall of the corresponding accommodating hole, and a lower end of the guide surface is flush with the lower end of the corresponding accommodating hole.

12. The electrical connector according to claim 10, wherein the second vertical central plane passes through the two extending portions.

13. The electrical connector according to claim 10, wherein when the two embracing arms of each of the terminals are expanded on a plane, the front ends of the two embracing arms of each of the terminals are connected to each other.

14. The electrical connector according to claim 10, wherein a base is formed by extending upward from the connecting portion and is positioned in a corresponding accommodating hole of the accommodating holes, a strip connecting portion is formed by extending upward from the base to be connected to a strip, an elastic arm is formed by bending upward and extending from the base to abut a mating component upward, the elastic arm has a first tearing edge formed with the strip connecting portion by tearing, a second tearing edge formed with the strip by tearing, and a blanking edge formed with the strip by blanking, and a notch is concavely provided on the elastic arm at a connection location between the blanking edge and the second tearing edge.

15. An electrical connector, comprising:

an insulating body, provided with a plurality of accommodating holes running through the insulating body vertically; and a plurality of terminals, respectively and correspondingly accommodated in the accommodating holes, wherein each of the terminals has a connecting portion, two side portions, two extending portions and two embracing arms, the two side portions respectively bend backward and extend from a left side and a right side of the connecting portion, the two extending portions are provided opposite to each other and extend downward from the two side portions, each of the two embracing arms is connected to a lower end of one of the extending portions, the two embracing arms jointly embrace a solder ball, the solder ball has a first vertical central plane in a front-rear direction and a second vertical central plane in a left-right direction, the second vertical central plane is perpendicular to the first vertical central plane, the two embracing arms are located on a left side and a right side of the first vertical central plane, a front end of each of the embracing arms passes forward beyond a front end of a corresponding one of the extending portions, the front end of each of the embracing arms pass forward beyond the second vertical central plane, a rear end of each of the embracing arms pass backward beyond the second vertical central plane, a distance between the front end of each of the embracing arms and the second vertical central plane is greater than a distance between the rear end of each of the embracing arms and the second vertical central plane, a distance between the front ends of the two embracing arms of each of the terminals is less than a distance between the rear ends of the two embracing arms of each of the terminals, and the front ends of the two embracing arms are close to each other, such that the front ends of the two embracing arms are both attached with solder liquid formed by melting of the solder ball during soldering, wherein a plurality of supporting blocks are provided to protrude upward from an upper surface of the insulating body to support a mating component, each of the supporting blocks is connected to two rear adjacent accommodating holes and one front adjacent accommodating hole of the accommodating holes, and a portion of each of the supporting blocks is located between the two rear adjacent accommodating holes.

16. The electrical connector according to claim 15, wherein when the solder ball is melted to form the solder liquid, a gap between the front ends of the two embracing arms of each of the terminals is filled with the solder liquid.

17. The electrical connector according to claim 15, wherein when the two embracing arms of each of the terminals are expanded on a plane, the front ends of the two embracing arms of each of the terminals are connected to each other.

18. The electrical connector according to claim 15, wherein a base is formed by extending upward from the connecting portion and is positioned in a corresponding accommodating hole of the accommodating holes, a strip connecting portion is formed by extending upward from the base to be connected to a strip, an elastic arm is formed by bending upward and extending from the base to abut a mating component upward, the elastic arm has a first tearing edge formed with the strip connecting portion by tearing, a second tearing edge formed with the strip by tearing, and a blanking edge formed with the strip by blanking, and a notch is concavely provided on the elastic arm at a connection location between the blanking edge and the second tearing edge.

19. The electrical connector according to claim 15, wherein the second vertical central plane passes through the two extending portions.

20. The electrical connector according to claim 15, wherein a portion of each of the embracing arms passing forward beyond the front end of the corresponding one of the extending portions is defined as a first protruding portion, each of the embracing arms has a second protruding portion passing backward beyond a rear end of the corresponding one of the extending portions, and a length of the first protruding portion is greater than a length of the second protruding portion.

* * * * *